US009831611B2

(12) United States Patent
Lehmann et al.

(10) Patent No.: US 9,831,611 B2
(45) Date of Patent: Nov. 28, 2017

(54) ELECTRICAL PLUG CONNECTOR

(71) Applicant: Delphi International Operations Luxembourg S.A.R.L., Bascharage (LU)

(72) Inventors: Rene Lehmann, Fuerth (DE); Vincent Regnier, Spardorf (DE)

(73) Assignee: Delphi International Operations Luxembourg, Sarl, Luxembourg (LU)

( * ) Notice: Subject to any disclaimer, the term of this patent is extended or adjusted under 35 U.S.C. 154(b) by 0 days.

(21) Appl. No.: 15/454,257

(22) Filed: Mar. 9, 2017

(65) Prior Publication Data

US 2017/0310053 A1 Oct. 26, 2017

(30) Foreign Application Priority Data

Apr. 25, 2016 (EP) ..... 16166810

(51) Int. Cl.
*H01R 4/66* (2006.01)
*H01R 13/648* (2006.01)
*H01R 13/10* (2006.01)

(52) U.S. Cl.
CPC ..... *H01R 13/6485* (2013.01); *H01R 13/10* (2013.01)

(58) Field of Classification Search
CPC .... H01R 13/6485; H01R 13/10; H01R 12/91; H01R 13/6461; H01R 13/1502; H01R 13/652; H01R 13/53; H01R 12/724; H01R 25/003
See application file for complete search history.

(56) References Cited

U.S. PATENT DOCUMENTS

| | | | | |
|---|---|---|---|---|
| 5,905,622 | A * | 5/1999 | Finlay, Sr. | H01C 7/12 361/111 |
| 9,088,094 | B2 * | 7/2015 | Iyer | H01R 13/53 |
| 9,257,761 | B2 * | 2/2016 | Hirakawa | H01R 13/652 |
| 9,306,312 | B2 * | 4/2016 | Dang | H01R 13/502 |
| 9,331,432 | B1 * | 5/2016 | Phillips | H01R 13/6461 |
| 9,653,831 | B2 * | 5/2017 | Hoyack | H01R 12/91 |
| 2005/0075007 | A1 * | 4/2005 | Benoit | H01R 25/003 439/536 |
| 2007/0207675 | A1 * | 9/2007 | Minich | H01R 12/724 439/108 |
| 2013/0309844 | A1 | 11/2013 | Takeda | |

FOREIGN PATENT DOCUMENTS

| | | | |
|---|---|---|---|
| DE | 102005016024 | A1 | 10/2006 |
| WO | 2004020933 | A1 | 3/2004 |
| WO | 2010070391 | A1 | 6/2010 |

* cited by examiner

*Primary Examiner* — Jean F Duverne
(74) *Attorney, Agent, or Firm* — Robert J. Myers

(57) ABSTRACT

A plug connector suitable for use as an airbag squib connector is presented. The plug connector includes a connector housing, having a plug-in portion and at least one female contact terminal that is arranged at least partially in the plug-in portion. The plug connector further includes a grounding contact, having an intermediate section and a contact section formed from sheet metal. The sections have respective main surfaces and circumferential edges. The contact section is configured to electrically contact a corresponding grounding contact of a counter-connector. The intermediate section branches off from the contact section. The main surfaces of the intermediate section and the contact section are parallel to the mating direction.

22 Claims, 6 Drawing Sheets

ELECTRICAL PLUG CONNECTOR

CROSS-REFERENCE TO RELATED APPLICATION

This application claims the benefit under 35 U.S.C. §119(a) of Patent Application No. 16166810.8 filed in the European Patent Office on Apr. 25, 2016, the entire disclosure of which is hereby incorporated by reference.

TECHNICAL FIELD OF THE INVENTION

The invention relates to an electrical plug connector, and in particular to an airbag squib connector that is configured to cooperate with an airbag squib retainer.

BACKGROUND OF THE INVENTION

Modern passenger cars have a number of airbags, such as front and side airbags, which serve to cushion the impact of the passenger with for example interior parts of a passenger car in case of an accident. The airbag assembly is usually located on the steering wheel or column, the dash board or the side of the door panels etc. The airbag surface is inflated by means of an explosive device known as a squib. The wires or cables from the crash sensors of the car are connected to the squib by means of a plug connector, the so called airbag squib connector. To this aim, the squib is provided with a socket (i.e. a counter-connector), which contains typically two contact pins. The airbag squib connector comprises a plug-in portion corresponding to the socket, respectively the counter-connector. To improve the connection between the airbag squib and the airbag squib connector, airbag squib retainer inserts are used, which are configured to fit into the receptacle of the airbag squibs and which facilitate and secure the connection between squib and squib connectors. These retainer inserts (also abbreviated as "retainer" or "insert") are commonly provided with some kind of electro-conductive clip, that short circuits the contact pins of the airbag squib before a squib connector is connected to the airbag squib. The socket and the retainer insert build the counter-connector of the airbag ignition system.

Further, it is required that the airbag squib connector is grounded before the terminals of the airbag squib connector come into contact with the pins of the airbag squib. To this end, the electro-conductive clips used in the past were often provided with some kind of grounding contact (sometimes also denoted as grounding contact), which establish electrical continuity between e.g. the body of the vehicle and the airbag squib connector upon mating of the airbag squib connector with the airbag squib.

An example of the principle structure of an airbag squib is described in International Patent Application WO 2004/020933. The airbag squib disclosed in this document comprises an outer casing enclosing an igniter including a suitable pyro-technique charge. The airbag squib is provided with two contact pins that are electrically connected to an igniter wire, which can activate the charge of the airbag squib.

In International Patent Application WO 2010/070391 A1, an airbag squib connector for an airbag ignition system is disclosed, which is provided with two electrical contact terminals and a grounding contact. The electrical contact terminals are configured to electrically contact electrical contact pins of an airbag squib and the grounding contact is configured to electrically contact a grounding clip of an airbag squib retainer. The grounding contact is arranged to establish an electrical contact to a grounding clip of the airbag squib retainer. The grounding clip is provided with two contact members to short circuit the electrical contact pins of the airbag squib and with first and second grounding contacts configured to establish ground continuity between the grounding contact of the an airbag squib connector and an electro-conductive part of the airbag squib. Particularly, a contact section of the grounding contact of the airbag squib connector is arranged laterally offset to a symmetrical plane of the airbag squib connector that extends between the two electrical contact terminals. Further, the contact section extends essentially parallel to the mating direction of the airbag squib connector to a mating face thereof, to ensure, that the grounding contact electrically contacts the grounding clip during mating, before the terminals and the pins electrically contact each other.

Due to the position and arrangement of the grounding contact in the airbag squib connector, the grounding contact is provided as bending part, wherein the length of the contact section is at least dependent on the bending radius, the bending position and the sheet material used. Thus, there is a certain risk, e.g. due to manufacturing tolerances, that a distal end of the contact section extends beyond the mating face of the airbag squib connector and disturbs and/or hinders the mating. Further, the retainer, the airbag squib connector and/or the grounding contact could be damaged and/or deformed during mating, and as a result correct mating could become impossible.

To provide an improved positioning of the distal end of the contact section, in the art connector housings are known, having a longitudinal T-shaped support groove, to support the arrangement of the contact section. Particularly, with providing a longitudinal T-shaped support groove that extends essentially along the entire length of the contact section, the influence of the bending radius on the length of the contact section can be reduced. However, providing a longitudinal T-shaped support groove requires complex molding tools for manufacturing the connector housing and leads to undesirable high friction during assembly of the airbag squib connector.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

It is therefore an object of the present invention to provide a grounding contact for a plug connector, particularly for an airbag squib connector, as well as an (airbag squib) plug connector that reduces or minimizes the above described problems and disadvantages, wherein the plug connector is configured to cooperate with an airbag squib retainer insert, respectively a socket of an airbag ignition system.

It is in particular a further object of the present invention to provide a plug connector, respectively an airbag squib connector, comprising a grounding contact that is easy to mount to the plug connector and that provides a secure and improved contacting with a corresponding grounding contact. Particularly, it is a further object of the invention to provide a plug connector, comprising an improved connector housing, wherein the housing is easier to manufacture and provides improved mating functionalities.

These and further objects which become apparent upon reading the following description. In particular, the objects are solved by a plug connector, notably by an airbag squib connector, wherein the plug connector comprises a connector housing, having a plug-in portion and at least one female contact terminal that is arranged at least partially in the plug-in portion. The plug connector further comprises a grounding contact, comprising an intermediate section and a contact section, formed from sheet metal, wherein the sections have respective main surfaces and circumferential edges, and wherein the contact section is configured to electrically contact a corresponding grounding contact of a counter-connector, and the intermediate section branches off from the contact section, wherein the main surfaces of the intermediate section and the contact section are oriented parallel to the mating direction.

The grounding contact, having a contact section, is configured to establish ground continuity between the plug connector, respectively an airbag squib connector and a grounding contact of a counter-connector, such as a grounding clip or an electro-conductive part of an airbag squib. This ground continuity is preferably established, before the at least one terminal of the plug connector electrically contacts a respective pin of the counter-connector.

The metal sheet can for example comprise a copper alloy or may be plated with further materials such as zinc, gold and or the like. Plated metal sheets can reduce the electrical contact resistance and can provide an improved corrosion resistance.

As the grounding contact comprises a contact section and an intermediate section that are formed from a sheet metal, and wherein the main surfaces of the sections, corresponding to the primary main surface of the metal sheet, are arranged substantially parallel to the mating direction of the plug connector, the length of the contact section is not dependent on any bending radius or sheet metal thickness. Thus, the length of the contact section can be manufactured very precisely, e.g. by cutting, stamping, or the like. The length of the contact section has to be understood as the length as measured from a distal end of the contact section to the branch-off of the intermediate section.

Due to the above described orientation of the main surfaces of the intermediate section and the contact section, an circumferential edge of the intermediate section, and in particular an edge of the intermediate section that is oriented toward the mating direction, is an engaging edge, which can engage with the connector housing. This engagement prevents the distal end of the contact section from protruding over the mating face of the plug-in portion of the plug connector, if the length of the contact section is shorter than the length of the plug-in portion.

Therefore, by choosing the length of the contact section with respect to the length of the plug-in portion, the distal end of the contact section and the mating face of the plug-in portion can be substantially flush. This allows the grounding contact to come into electrical contact with a corresponding grounding contact of a counter-connector, before the terminals and respective pins electrically contact each other during mating. Further, the risk of damaging the plug connector, the grounding contact and/or a corresponding counter-connector can be minimized.

Particularly, the contact section may extend in a direction parallel to the mating direction A, and the intermediate section preferably branches off perpendicular to the contact section, wherein the main surfaces of the intermediate section and the contact section are preferably arranged in the same plane.

If the contact section extends in a direction parallel to the mating direction, a corresponding grounding contact of a counter-connector can be guided along the grounding contact while being an electrical contact during the mating of the plug connector with the corresponding counter-connector. Thus, the grounding continuity is not interrupted during mating. A perpendicular branch-off of the intermediate section allows a facilitated design and respective bending of the intermediate section. If the sections shall be arranged in the same plane, after cutting the sections out of the sheet metal, no further bending process is required, so that manufacturing costs can be reduced.

In an example embodiment, the length of the contact section is not dependent on the bending of the contact section, or a bending between the contact section and the intermediate section. Therefore, the contact section and the intermediate section are cut from a sheet of metal in a substantially L-shaped pre-form. A first blade of the L-shaped pre-form corresponds to the contact section, and a second blade corresponds to the intermediate section. After cutting the pre-form, the second blade of the L-shaped pre-form can be bent around a bending axis that is parallel to the direction of extension of the first blade, i.e. the contact section. Thus, an intermediate section is formed, whose main surface is parallel to the mating direction A. Thus, despite the bending, the length of the contact section is not dependent on the bending radius, and the like, since the bending axis is parallel to the direction of extension of the contact section.

Further, the grounding contact may comprise a connecting section, which extends through the connector housing and is configured to be connected to a grounding cable, wherein the connecting section is connected to the contact section via the intermediate section. The connecting section that is configured to be connected to a grounding cable can be a crimp portion, a solder portion, a welding portion or the like to allow the cable to be electrically connected to the connection section. Thereby, the connection section is formed to guide the grounding contact through the connector housing.

Moreover, the at least one female contact terminal may be provided with an electrical signal line that extends through the connector housing, and the connecting section may extend essentially parallel to the electrical signal line, preferably in a plane that is perpendicular to the mating direction A, wherein the intermediate section extends essentially in the same plane. If the connection section extends essentially parallel to the electrical signal line, the connection to the respective signal and/or grounding cable(s) or respective wires is facilitated, since the cable(s) or the wires of the cables can be arranged parallel to each other. Thus, the automated connection between the respective sections and the respective cables/wires can be facilitated.

Besides, the intermediate section and the contact section and preferably the connecting section can be formed from a single piece of metal sheet. Forming the intermediate section and at least the contact section from a single piece of metal sheet, leads to reduced manufacturing costs, since the cutting and optional subsequently bending of terminals are well established manufacturing processes that are very cost effective.

Further, the plug connector may comprise at least two female contact terminals, which are arranged at least partially in the plug-in portion, and the contact section of the grounding contact may be arranged at least partially in the plug-in portion of the connector housing, and is preferably symmetrically arranged to the female contact terminals. If the grounding contact is at least partially provided in the plug in portion, it is protected from environmental influences, thereby leading to a more reliable plug connector. Still further, the symmetrical arrangement of the contact section relative to the female contact terminals, allows electrically contact the grounding contact of a counter-connector during mating, before the contact terminals come into electrical contact with the respective contact pins, even if the plug connector and the corresponding counter-connector are mated under an undesired angle.

Moreover, the contact section of the grounding contact can comprise a distal end that does not protrude over the mating face of the plug-in portion in the mating direction A, wherein the distal end of the contact section is preferably flush with the mating face of the plug-in portion. A grounding contact providing a distal end that does not protrude over the mating face of the plug-in portion, guarantees that the mating is not disturbed and that the plug connector, the counter-connector and in particular the contact section of the grounding contact of the plug connector are not damaged during mating. Thus, the plug connector is more reliable.

This can be achieved, by choosing a suitable length of the contact section. Since the length of the contact section is not dependent on the sheet material thickness and respective bending radiuses, as previously discussed, the length can be manufactured very precisely with a minimal tolerances, e.g. by cutting, stamping or the like. Thus, a flush arrangement of the distal end of the contact section and the mating face of the plug-in portion can be achieved. Particularly, a flush arrangement allows an instantaneous electrical contacting of the grounding contact during mating the plug connector with a corresponding counter-connector, before the terminals and/or pins electrically contact each other. This is in particular important in airbag ignition systems, since an unintentional activation of the squib can be prevented.

Further, the connector housing may comprise a longitudinal guiding groove that is configured to receive the contact section of the grounding contact, wherein the guiding groove may preferably surround at least three sides of the contact section. Providing a guiding groove facilitates the positioning of the contact section in the connector housing, so that an unintentional displacement or an incorrect mounting of at least the contact section, preferably of the entire grounding contact, can be effectively prevented. If the guiding groove surrounds at least three sides of the contact section, a lateral displacement can be effectively prevented. For example, the guiding groove can be provided in a side wall of the plug-in portion of the plug connector so that the main surface and two circumferential edges of the contact section are at least partially surrounded by the guiding groove, providing a secure lateral guiding.

Further, the connector housing can comprise a blocking means in proximity to the mating face of the plug-in portion, wherein the contact section comprises a corresponding blocking portion that is configured to be in blocking contact with the blocking means, so that the distal end of the contact section is prevented from protruding over the mating face of the plug-in portion in the mating direction A. Providing a corresponding blocking portion on the contact section of the grounding contact, allows a defined blocking contact, in order to determine a defined position of the contact section. Arranging the blocking means in proximity of the mating face of the plug-in portion, facilitates the mounting of the contact section within the connector housing, since the blocking means provide a mechanical stop for the contact section. Thus, a distal end of the contact section can be inserted in the housing, until the blocking portions and blocking means come into blocking contact. The blocking contact prevents the distal end of the contact section to protrude over the mating face of the plug-in portion of the plug connector. For example, the blocking means can be provided as protrusions that preferably protrude into the guiding groove.

Particularly, the distal end of the contact section of the grounding contact may have a reduced width to form the corresponding blocking portion, and/or protrusions may be provided in proximity to the distal end of the contact section, to form the corresponding blocking portion. Providing a reduced width and/or protrusions to form the corresponding blocking portion of the contact section of the grounding contact, allows to arrange the distal end of the contact portion substantially flush with the mating face of the plug-in portion of the plug connector. Thus, the electrical contact between the grounding contact and the corresponding grounding contact can be securely established during mating, before a contact terminal and a respective pin electrically contact each other.

Moreover, the connector housing may comprise a positioning recess that is configured to receive the contact section of the grounding contact at least partially, wherein the positioning recess surrounds three sides of the contact section entirely, and a fourth side of the contact section at least partially. A positioning recess, that surrounds the contact section on three sides entirely and in a fourth side at least partially, defines the lateral orientation of the grounding contact. For example, the circumferential edges and main surface of the contact section can be entirely surrounded wherein the fourth side, i.e. the second main surface is at least partially surrounded. Thus, the contact section can be clamped to the positioning recess. For example, the positioning recess can be formed on a distal end of the guiding groove, in proximity to the mating face. Thus, the position of the distal end of the contact section can be determined very precisely.

Further, the positioning recess may extend in mating direction A and may have an essentially c-shaped cross-sectional form in a plane perpendicular to the mating direction A. An essentially c-shaped cross sectional form in a plane perpendicular to the mating direction A, for the positioning recess is preferred, since this form is easy to manufacture and allows an exact positioning of the distal end of the contact section. If the contact section is inserted into the positioning recess, the final position of the distal end of the contact section is exactly defined.

Still further, the positioning recess may extend in mating direction A and may have a length that is at most half the length of the contact section as measured from the distal end of the contact section to the branch-off of the intermediate section, preferably at most a third of said length of the contact section and most preferably at most a quarter of said length of the contact section.

Providing a reduced length of the positioning recess, compared to the length of the contact section facilitates the insertion of the contact section into the positioning recess, since friction forces are reduced. Thus, the grounding contact can be mounted very easily. Still further, if the length of the positioning recess is reduced, the manufacturing of the recess is also facilitated. Typically, the connector housing is formed by means of injection molding from a plastic material. Providing a positioning recess with reduced length, facilitates the molding of the connector housing and therefore reduces production costs.

Particularly, the longitudinal guiding groove and/or the blocking means and/or the positioning recess may be integrally formed, preferably in a sidewall of the plug-in portion. Integrally forming the longitudinal guiding groove, the blocking portion and the positioning recess leads to reduced space requirements. For example, the guiding groove can be provided in side wall of the plug-in portion of the plug connector. Preferably, the guiding groove is provided in an inner peripheral surface of the plug-in portion. The guiding groove further, can be restricted in mating direction A via the blocking means that are formed as protrusions, protruding into the guiding groove. Finally, the positioning recess can be formed by providing a further section that covers the guiding groove at least partially on a fourth side. Thus, the guiding, positioning and blocking of the respective guiding grooves, positioning recess and blocking means can be achieved in close proximity to each other and therefore providing a precise positioning of the distal end of the contact section of the grounding contact.

Moreover, the connector housing can comprise an engaging means that is configured to engage with the intermediate section of the grounding contact, wherein the engaging means is configured to urge the intermediate section into the mating direction A, and wherein the engaging section is preferably aligned with the contact section. The engaging means can be provided as or on an internal wall of the connector housing, preferably as protrusion(s), that urges the intermediate section into the mating direction A. Therefore, the grounding contact, and in particular the contact section, is prevented from being displaced opposite to the mating direction, particularly, during mating the plug connector to the corresponding counter-connector.

Still further, by urging the intermediate portion into the mating direction, the position of the contact section is defined more precisely. Urging the intermediate section into the mating direction A will lead to an engagement between the intermediate section and the connector housing. Thus, the position of the intermediate section and the contact section in mating direction is fixed. If further blocking means are provided, the contact section will be urged by means of the engaging means in blocking contact with the blocking means so that the position of the distal end of the contact section is fixedly secured.

Further, the objects are solved by a grounding contact for being used in a plug connector, preferably in an airbag squib connector, as previously described, wherein the grounding contact, comprising an intermediate section and a contact section formed from sheet metal, wherein the sections have respective main surfaces and circumferential edges, wherein the contact section is configured to electrically contact a corresponding grounding contact of a counter-connector, and wherein the intermediate section branches off from the contact section, and wherein the main surfaces of the intermediate section and the contact section are parallel to the mating direction A, and may be preferably arranged in the same plane. In particular, the grounding contact will achieve the advantages discussed above, when being mounted in a respective plug connector or an airbag squib connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
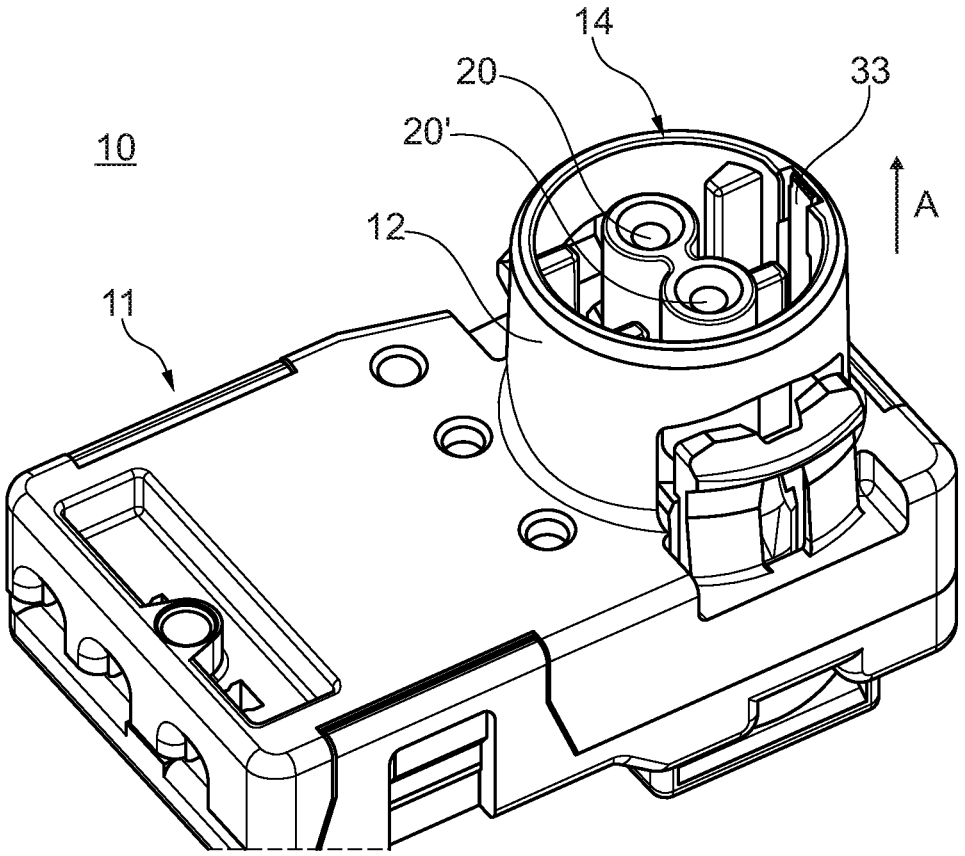
FIG. 1 shows a schematic perspective view of a plug connector.

In particular, FIG. 1 shows a plug connector 10 having a connector housing 11 that is formed form at least two parts. The connector housing 11 comprises a plug-in portion 12. Two female contact terminals 20, 20' are provided centered in the plug-in portion 12. The plug-in portion 12 is provided with a distal front face, which is a mating face 14. In a peripheral side wall of the plug-in portion 12, a contact section 33 of a grounding contact 30 is received.

Figure 2A:
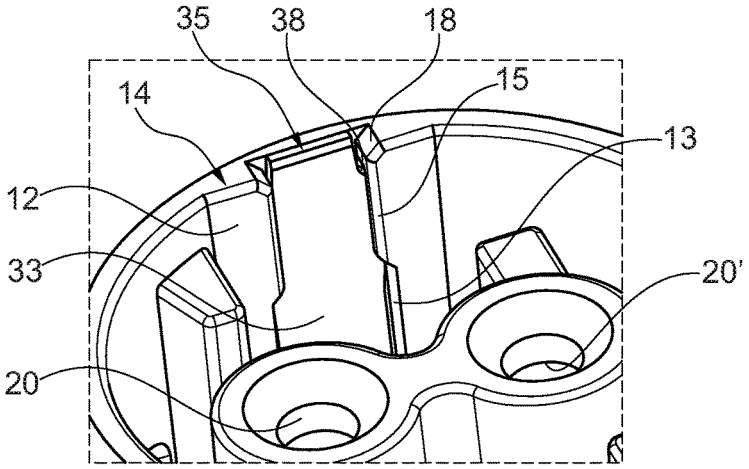
FIG. 2A shows a detailed schematic view of a distal end of a contact section.
Figure 2B:
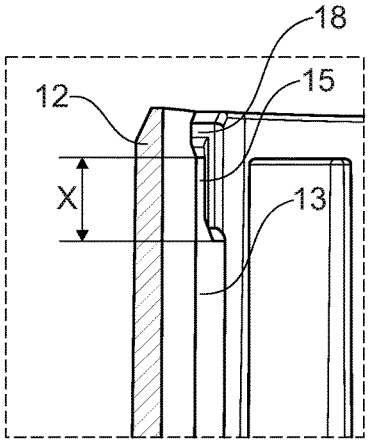
FIG. 2B shows a detailed cut-view of a positioning recess.
Figure 2C:
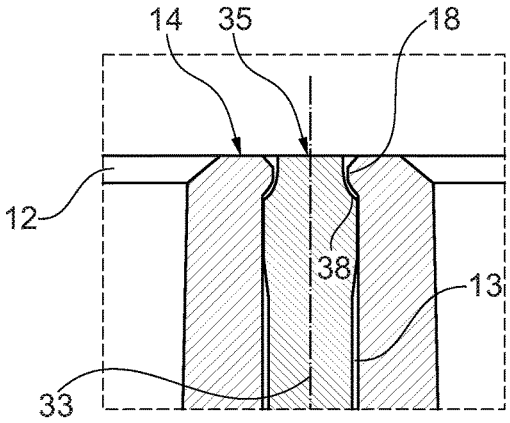
FIG. 2C shows a detailed cut-view of a distal end of a contact section being received in a positioning recess.

As can be best seen in FIGS. 2A and 2C, the contact section 33 of the grounding contact 30 comprises a distal end 35 that is provided flush with the mating face 14 of the plug-in portion 12. The plug-in portion 12 is provided with a guiding groove 13 that guides the contact section 33 on at least three sides. In particular, the guiding groove 13 is provided in an inner peripheral side of the side wall of the plug-in portion 12 and guides the contact section 33 on a main surface side and two circumferential edges.

In proximity to the mating face 14, a blocking means 18 is provided that is in blocking contact with a blocking portion 38 of the contact section 33. The blocking portion 38 is provided as two protrusions. Alternatively, the distal end 35 of the contact section 33 could be provided with a reduced width, in order to provide a blocking portion 38. Still further, the forth side of the contact section 33 is at least partially covered by a positioning recess 15.

As best can be seen in the partial cut-view of FIG. 2B, the positioning recess 15 guides the contact section 33 on three sides entirely and on the fourth side partially. Further, the length x of the positioning recess 15 is shorter than the length d of the contact section 33. In the present embodiment, the length x is at most half as long as the length d of the contact section 33.

In FIG. 2B, blocking means 18 are shown that protrude into the guiding groove 13, in order to provide a blocking contact with the blocking portion 38 of the contact section 33. Due to the blocking contact, the distal end 35 of the contact section 33 can be arranged flush or essentially flush with the mating face 14 of the plug-in portion 12.

Figure 3A:
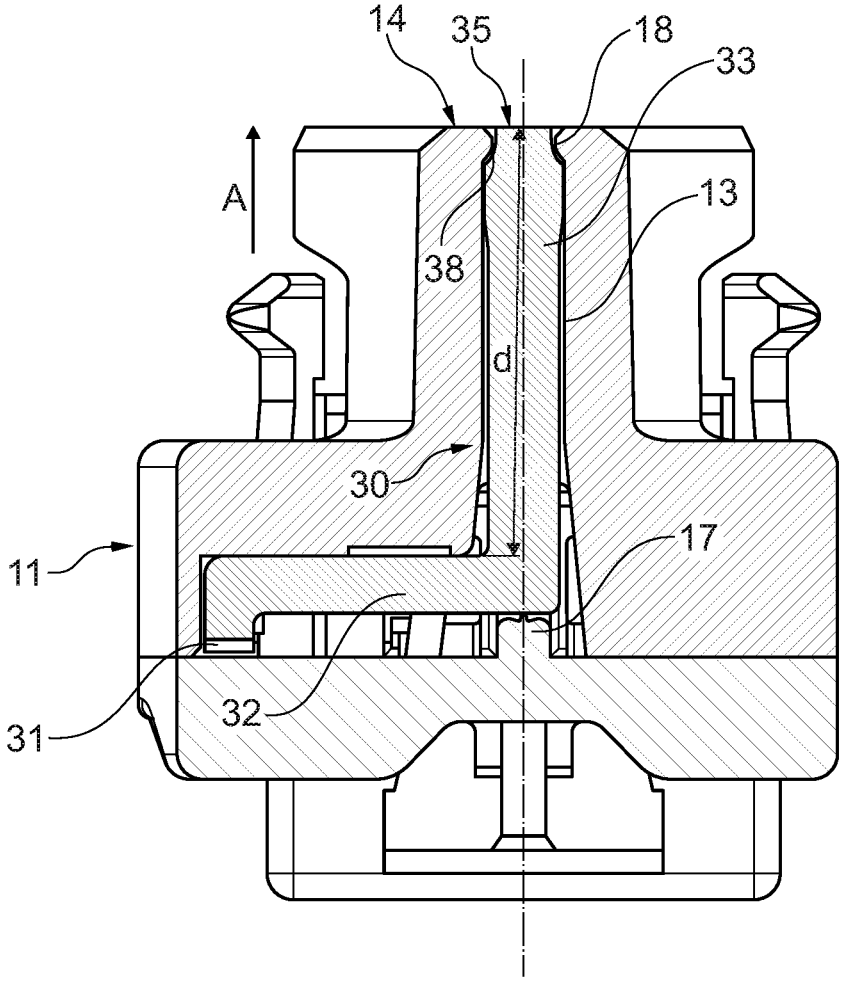
FIG. 3A shows a schematic cut-view of a grounding contact, being arranged in a connector housing.
Figure 3B:
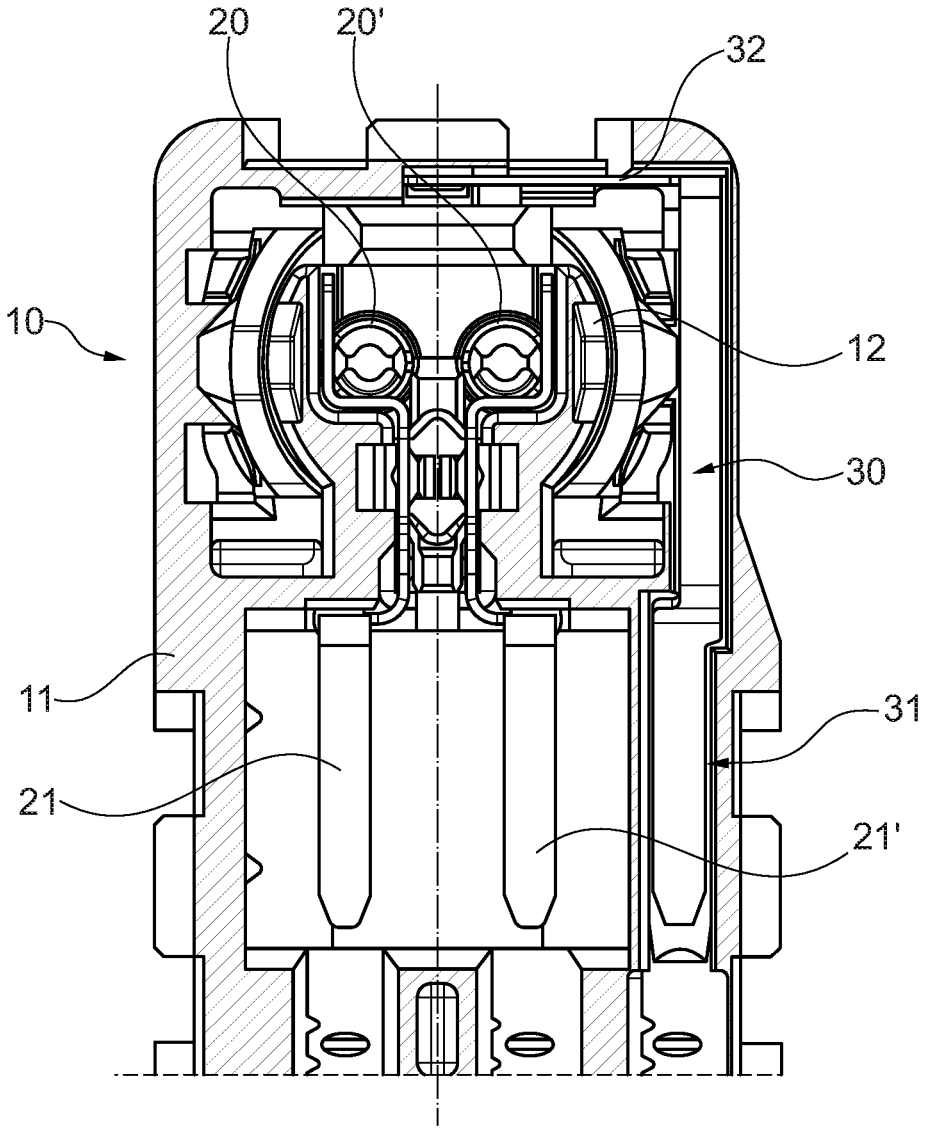
FIG. 3B shows a further view of a grounding contact being arranged in a connector housing.

FIG. 3A shows a cut view of the plug connector 10, wherein the plug connector 10 is cut in a plane of the contact section 33. As can be seen, the main surface of the contact section 33 and the main surface of the intermediate section 32 are oriented parallel to the mating direction A. The connecting section 31, which is best shown in FIG. 3B, extends into the plane of projection of FIG. 3A. Thus the main surface of the connecting section 31 is substantially perpendicular to the mating direction A. The intermediate section 32 is engaged with the engaging means 17 of the connector housing 11. The engaging means 17 is aligned with the contact section 33 of the grounding contact 30. The engaging means 17 urges the intermediate section 32 in mating direction A, against an inner surface of the connector housing 11. Thereby, the distal end 35 of the contact section 33 is also urged into mating direction A and can be arranged flush with the mating face 14 of the plug-in portion 12.

In particular, the length d of the contact section 33 defines the final position of the distal end 35 of the contact section 33 in mating direction A. Since the length d of the contact section 33 (measured from the distal end 35 to the branch-off of the intermediate section 32) is not dependent on a bending radius or on the sheet thickness, the axial position of the distal end 35 can be defined very precisely.

By providing additional blocking means 18 that protrude into the guiding groove 13, the exact axial positioning of the distal end 35 of the contact section 33 is further facilitated. This is achieved by a blocking contact between the blocking means 18 and the corresponding blocking portion 38 of the contact section 33. Still further, the engaging means 17 urges the contact section 33, and in particular the blocking portion 38, in blocking contact with the blocking means 18.

FIG. 3B shows a partial cut view of the plug connector 10, wherein the plug connector 10 is cut in a plane perpendicular to the mating direction A. The plug connector 10 comprises two female contact terminals 20, 20', which are arranged at least partially in the plug-in portion 12. The two female contact terminals 20, 20' are provided with respective electrical signal lines 21, 21' that extend through the connector housing 11 and that can be connected with respective signal cables or wires (not shown). Further, the grounding contact 30 comprises a connecting section 31 that extends essentially parallel to the electrical signal lines 21, 21' and preferably in a plane that is perpendicular to the mating direction A. Further, the connecting section 31 of the grounding contact 30 comprises a main surface, which is preferably in the same plane as the electrical signal lines 21, 21' of the two female contact terminals 20, 20'. Particularly, the connecting section 31 is configured to be connected to a grounding cable/wire, preferably by means of welding, soldering crimping and/or the like.

Figure 4A:
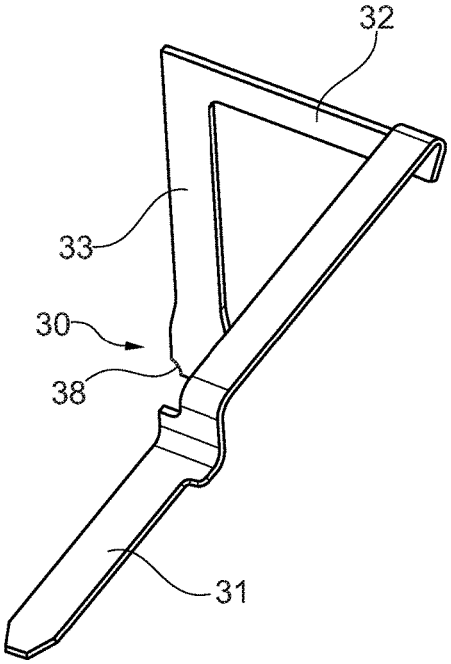
FIG. 4A shows a schematic perspective view of a grounding contact.

FIG. 4A shows a schematic perspective view of a grounding contact 30. The grounding contact 30 comprises a connecting section 31, an intermediate section 32 and a contact section 33. Preferably, the grounding contact 30 is formed as an integral part from a single metal sheet as best seen in FIG. 4B.

When mounted to a plug connector 10, the contact section 33 will extend into the mating direction A. The contact section 33 and the intermediate section 32 comprise a main surface and circumferential edges, wherein the main surfaces are arranged parallel to that mating direction A, if the grounding contact 30 is mounted to a plug connector 10. In the embodiment shown, the main surfaces of the contact section 33 and the intermediate section 32 are arranged in the same plane. Further, at a distal end 35 of the contact section 33, protrusions are provided to form a blocking portion 38.

Figure 4B:
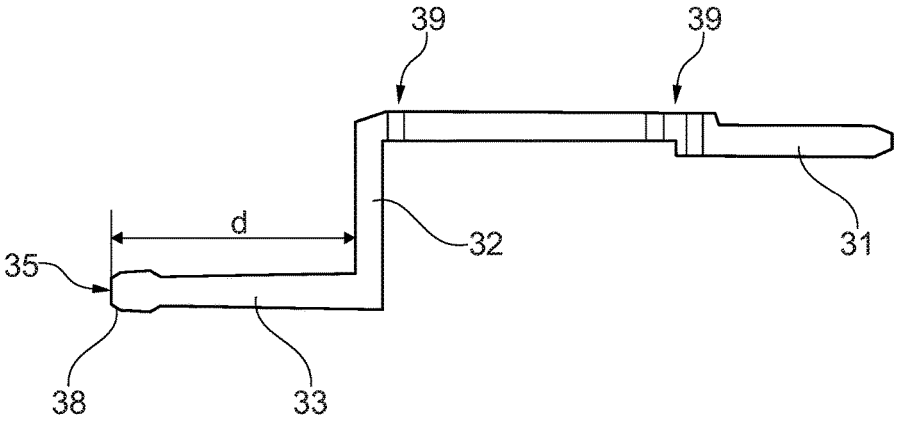
FIG. 4B shows a schematic view of a pre-form of a grounding contact.

FIG. 4B shows a pre-form of the grounding contact 30. The pre-form is cut out form a single metal sheet, and is preferably stamped. By bending the pre-form at the bending lines 39, indicated as lines perpendicular to the circumferential edge, the grounding contact 30 as shown in FIG. 4A can be formed. Further, the grounding contact 30 comprises a contact section 33 having a length d (measured from the distal end 35 to the branch-off of the intermediate section 32). In proximity to the distal end 35 of the contact section 33, a blocking portion 38 is provided by means of protrusion. The intermediate section 32 interconnects the connecting section 31 with the contact section 33.

Figure 5:
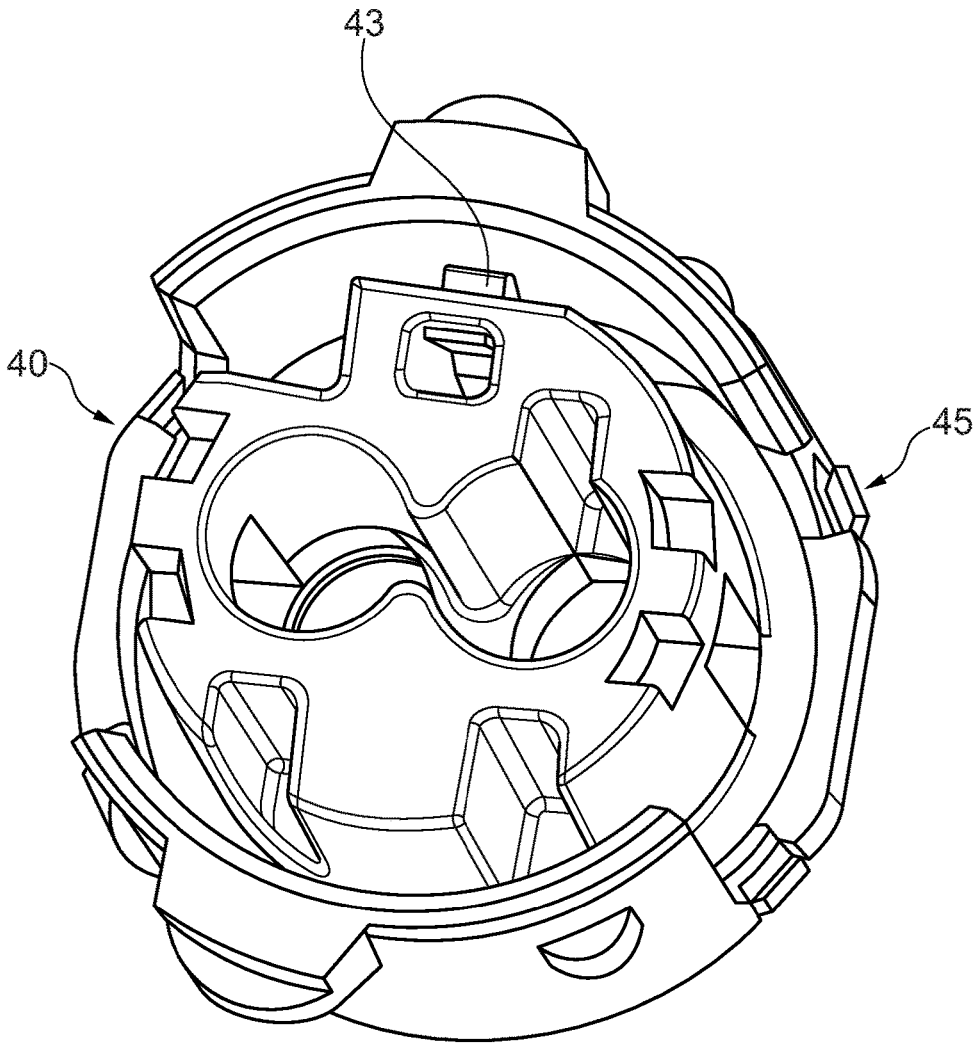
FIG. 5 shows a schematic perspective view of a counter-connector.

FIG. 5 shows a schematic view of a corresponding counter-connector 40, for example an airbag squib retainer. The counter-connector 40 is provided with an electrical grounding contact 43 that is configured to be in contact with the grounding contact 30 of the plug connector 10, if the plug connector 10 is mated with the counter-connector 40. Still further, a lateral grounding contact 45 is provided to electrically connect the grounding contact 43 of the counter-connector 40 with a connector housing 11, such as a socket of an airbag squib (not shown).

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A plug connector, comprising:

a connector housing having a plug-in portion;

at least one female contact terminal arranged at least partially in the plug-in portion, and a grounding contact, comprising an intermediate section and a contact section formed from sheet metal, wherein the intermediate section and the contact section have respective main surfaces and circumferential edges, wherein the contact section is configured to electrically contact a corresponding grounding contact of a counter-connector and the intermediate section branches off from the contact section, and wherein the main surfaces of the intermediate section and the contact section are oriented parallel to a mating direction.

2. The plug connector according to claim 1, wherein the contact section extends in a direction parallel to the mating direction, wherein the intermediate section branches off perpendicular to the contact section, and wherein the main surfaces of the intermediate section and the contact section are arranged in the same plane.

3. The plug connector according to claim 2, and wherein the main surfaces of the intermediate section and the contact section are arranged in the same plane.

4. The plug connector according to claim 2, wherein the main surfaces of the intermediate section and the contact section are arranged in the same plane.

5. The plug connector according to claim 1, wherein the grounding contact further comprises a connecting section which extends through the connector housing and is configured to be connected to a grounding cable and wherein the connecting section is connected to the contact section via the intermediate section.

6. The plug connector according to claim 5, wherein the at least one female contact terminal is provided with an electrical signal line that extends through the connector housing, wherein the connecting section extends essentially parallel to the electrical signal line.

7. The plug connector according to claim 6, wherein the connecting section extends in a plane that is perpendicular to the mating direction and wherein the intermediate section extends essentially in the same plane.

8. The plug connector according to claim 6, wherein the intermediate section and the contact section are formed from a single piece of metal sheet.

9. The plug connector according to claim 1, wherein the plug connector comprises at least two female contact terminals which are arranged at least partially in the plug-in portion and wherein the contact section of the grounding contact is arranged at least partially in the plug-in portion of the connector housing.

10. The plug connector according to claim 1, wherein the contact section of the grounding contact comprises a distal end that does not protrude over a mating face of the plug-in portion in the mating direction.

11. The plug connector according to claim 10, wherein the distal end of the contact section is flush with the mating face of the plug-in portion.

12. The plug connector according to claim 10, wherein the connector housing comprises a longitudinal guiding groove that is configured to receive the contact section of the grounding contact.

13. The plug connector according to claim 12, wherein the guiding groove surrounds at least three sides of the contact section.

14. The plug connector according to claim 12, wherein the connector housing comprises a blocking means in proximity to the mating face of the plug-in portion and wherein the contact section comprises a corresponding blocking portion that is configured to be in blocking contact with the blocking means, so that the distal end of the contact section is prevented form protruding over the mating face of the plug-in portion in the mating direction.

15. The plug connector according to claim 14, wherein the distal end of the contact section of the grounding contact has a reduced width to form the corresponding blocking portion and wherein protrusions are provided in proximity to the distal end of the contact section to form the corresponding blocking portion.

16. The plug connector according to claim 12, wherein the connector housing comprises a positioning recess that is configured to receive the contact section of the grounding contact at least partially and wherein the positioning recess surrounds three sides of the contact section entirely, and a fourth side of the contact section at least partially.

17. The plug connector according to claim 16, wherein the positioning recess extends in the mating direction and has an essentially c-shaped cross-sectional form in a plane perpendicular to the mating direction.

18. The plug connector according to claim 17, wherein the positioning recess has a length that is at most half the length of the contact section as measured from the distal end of the contact section to the branch-off of the intermediate section.

19. The plug connector according to claim 16, wherein the longitudinal guiding groove, the blocking means, and the positioning recess are integrally formed.

20. The plug connector according to claim 19, wherein the longitudinal guiding groove, the blocking means, and the positioning recess are formed in a sidewall of the plug-in portion.

21. The plug connector according to claim 1, wherein the connector housing comprises an engaging means that is configured to engage with the intermediate section of the grounding contact and wherein the engaging means is configured to urge the intermediate section into the mating direction.

22. The plug connector according to claim 21, wherein an engaging section is aligned with the contact section.

* * * * *